US010971834B1

(12) United States Patent
Chen

(10) Patent No.: US 10,971,834 B1
(45) Date of Patent: Apr. 6, 2021

(54) ELECTRICAL CONNECTOR

(71) Applicant: Xiamen Ghgm Electric Co., Ltd., Xiamen (CN)

(72) Inventor: Bingshui Chen, Xiamen (CN)

(73) Assignee: XIAMEN GHGM ELECTRIC CO., LTD., Xiamen (CN)

( * ) Notice: Subject to any disclaimer, the term of this patent is extended or adjusted under 35 U.S.C. 154(b) by 0 days.

(21) Appl. No.: 16/739,097

(22) Filed: Jan. 9, 2020

(30) Foreign Application Priority Data

Dec. 12, 2019 (CN) ..... 201911274836.X

(51) Int. Cl.
*H01R 4/24* (2018.01)
*H01R 12/70* (2011.01)
*H01R 4/48* (2006.01)

(52) U.S. Cl.
CPC ..... *H01R 12/707* (2013.01); *H01R 4/4836* (2013.01)

(58) Field of Classification Search
CPC .... H01R 4/4836; H01R 13/502; H01R 11/11; H01R 12/716; H01R 12/515; H01R 12/58; H01R 9/2416
USPC ..... 439/441, 266, 268
See application file for complete search history.

(56) References Cited

U.S. PATENT DOCUMENTS 6,007,369 A * 12/1999 Kennedy ..... H01R 4/4836 439/268
8,444,443 B2 * 5/2013 Schafmeister ..... H01R 4/4836 439/725
8,672,703 B2 * 3/2014 Fehling ..... H01R 4/4827 439/417
8,900,010 B2 * 12/2014 Aoki ..... H01R 4/185 439/587
2013/0029516 A1 * 1/2013 Miyawaki ..... H01R 13/6272 439/352

* cited by examiner

*Primary Examiner* — Phuong Chi Thi Nguyen

(57) ABSTRACT

An electrical connector includes a housing which is provided with an installation cavity and a jack. A conductive clamp and a movable member are configured in the housing. The conductive clamp is provided with at least one pair of first clamping pieces and at least one pair of releasing pieces. The first clamping pieces and the releasing pieces extend into the installation cavity. The movable member is capable of moving back and forth along the installation cavity. A conducting wire is capable of passing through the jack and is inserted into one pair of first clamping pieces. The movable member is capable of moving forward along the installation cavity, and abutting on one pair of releasing pieces, to force the releasing pieces and drive the first clamping pieces to open outward, so that the conducting wire is capable of detaching from the first clamping pieces.

9 Claims, 4 Drawing Sheets

ELECTRICAL CONNECTOR

CROSS-REFERENCE TO RELATED APPLICATIONS

The present application claims the benefit under 35 U.S.C. § 119 of China Patent Application No. 201911274836X, filed on Dec. 12, 2019 in the China National Intellectual Property Administration, the content of which is hereby incorporated by reference.

TECHNICAL FIELD

The present invention relates to the field of electrical connector technologies, and specifically, to an electrical connector.

BACKGROUND

An electrical connector is an electrical connection apparatus that connects a conducting wire with another conducting wire; a conducting wire with a printed circuit board ("PCB"); or a PCB with another PCB.

Currently, a connector used to connect a conducting wire and a PCB usually includes a housing and a conductive clamp. When the conducting wire is inserted into the conductive clamp, a barb structure of the conductive clamp makes it very difficult to pull out the conducting wire. In addition, because the electrical connector becomes more miniaturized, it is also difficult for operators to manually open the conductive clamp.

SUMMARY

The present disclosure provides an electrical connector with an inserted conducting wire that can be pulled out easily.

The present disclosure provides an electrical connector, which can include: a housing, provided with an installation cavity and a jack communicating with the installation cavity;

a conductive clamp, configured in the housing, where the conductive clamp is provided with at least one pair of first clamping pieces and at least one pair of releasing pieces respectively configured on the first clamping pieces, and the first clamping pieces and the releasing pieces are all located in the installation cavity;

a movable member, where the movable member is configured in the housing and is capable of moving back and forth along the installation cavity; and a conducting wire, where the conducting wire is capable of passing through the jack and is inserted into one pair of first clamping pieces, so that the conducting wire is electrically connected to the conductive clamp; the movable member is capable of moving forward along the installation cavity, and abutting on one pair of releasing pieces, to force releasing pieces and drive the first clamping pieces to open outward, so that the conducting wire is capable of detaching from the first clamping pieces.

A side wall of the installation cavity can be provided with a first sliding channel, and the movable member is capable of moving back and forth along the first sliding channel.

The conductive clamp can be provided with a second sliding channel, and the movable member is capable of moving back and forth along the second sliding channel.

The first sliding channel can be obliquely disposed on the side wall of the installation cavity, and the movable member is provided with a sliding protrusion adaptable to the first sliding channel.

The first sliding channel and the horizontal plane can form an angle in a range of 15° to 35°.

The releasing piece can be a C-shaped sheet-like member, and the pair of releasing pieces is respectively configured on the pair of first clamping pieces in a back-to-back manner.

The installation cavity can be provided with at least one pair of limiting protrusions, and the movable member is provided with clamping protrusions that have a quantity consistent with a quantity of the limiting protrusions and that are adaptable to the limiting protrusions, and the limiting protrusions are capable of preventing the movable member from detaching from the installation cavity.

A front end of the movable member can be provided with an abutting portion extending forward, and two sides of the abutting portion gradually shrink forward.

An operating groove used to drive the conductive clamp to move back and forth is disposed on an upper surface of the movable member, and the operating groove tilts forward and is disposed on the upper surface of the movable member.

The releasing pieces can be located on the first clamping pieces.

In the electrical connector in the present disclosure, the movable member that may move back and forth is disposed to enable the conducting wire to conveniently detach from the electrical connector. The conducting wire is inserted into the pair of first clamping pieces through the jack, to open the first clamping pieces outward. The first clamping pieces opening outward tightly clamp the conducting wire under an action of reset force. When the conducting wire needs to detach from the electrical connector, the movable member is pushed forward, and the front end of the movable member abuts on the pair of releasing pieces, to force the pair of releasing pieces to open outward. The pair of releasing pieces opening outward drives the pair of first clamping pieces to respectively spread to both sides, so that the first clamping pieces no longer clamp the conducting wire, and the conducting wire detaches from the releasing pieces. When acting force driving the movable member to move forward is canceled, the pair of releasing pieces opening outward pushes, under the action of reset force, the movable member to move backward. In addition, the first clamping pieces also resets, so that the first clamping pieces may clamp the conducting wire again when the conducting wire is inserted next time.

The movable member in the electrical connector in this specification is driven to move back and forth, so that the conducting wire may be conveniently clamped by the conductive clamp, or conveniently detach from the conductive clamp.

BRIEF DESCRIPTION OF THE DRAWINGS

In order to more clearly illustrate the technical solutions of the embodiments of the present disclosure, the drawings used in the embodiments will be briefly described below. It should be understood that the drawings show only certain embodiments of the present disclosure, and therefore should be seen as a limitation on the scope, and those skilled in the art can obtain other related drawings according to these drawings without any inventive work.

DETAILED DESCRIPTION

Figure 1:
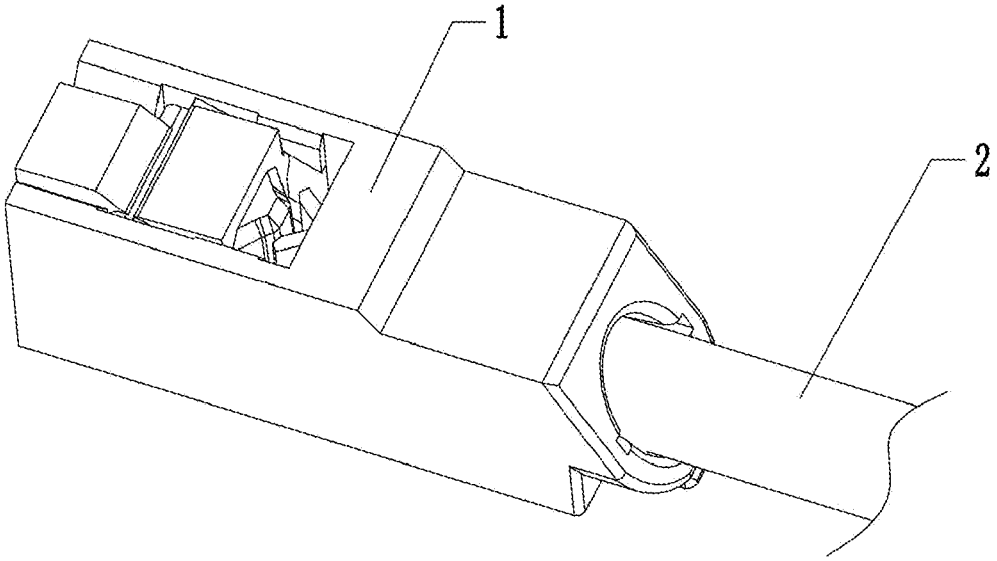
FIG. 1 is a shaft-side schematic structural diagram of an electrical connector according to an embodiment of the present disclosure.
Figure 2:
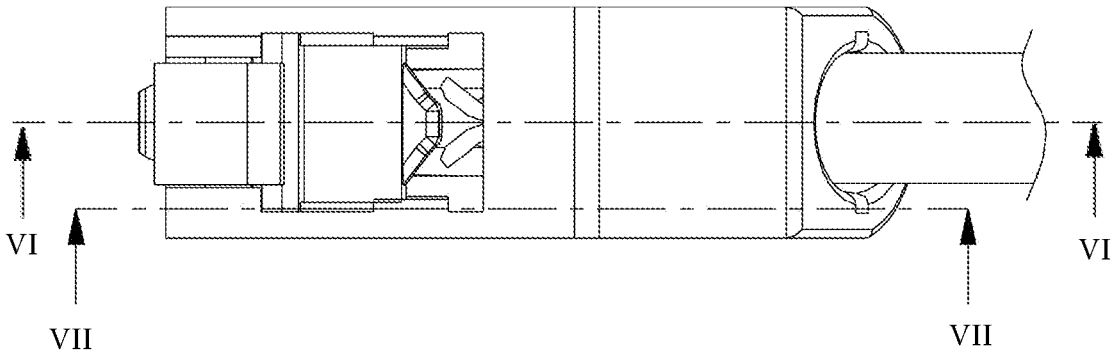
FIG. 2 is a schematic structural top view of an electrical connector according to an embodiment of the present disclosure.

The embodiments of the present disclosure will be clearly and completely described in conjunction with the drawings of the embodiments of the present disclosure. Apparently, what is described are some but not all of the embodiments of the present disclosure. All other embodiments obtained by a person of ordinary skill in the art based on the embodiments of the present disclosure without creative efforts are within the scope of the present disclosure. Therefore, the following detailed description of the embodiments of the present disclosure are not intended to limit the scope of the present disclosure, but to explain the selected embodiments of the present disclosure. All other embodiments obtained by a person of ordinary skill in the art based on the embodiments of the present disclosure without creative efforts are within the scope of the present disclosure.

In the description of the present disclosure, it is to be understood that the orientational or positional relationships indicated by the terms "center", "longitudinal", "transversal", "length", "width", "thickness", "upper", "lower", "front", "rear", "left", "right", "vertical", "horizontal", "top", "bottom", "inside", "outside", "clockwise", "counterclockwise", etc. are based on the orientation or positional relationship shown in the drawings, are merely for the convenience of describing the present disclosure and simplifying the description, and do not indicate or imply that the device or component referred to must have a specific orientation or be constructed and operated in a specific orientation. Therefore, it should not be construed as limiting the present disclosure.

Moreover, the terms "first" and "second" are used for descriptive purposes only and are not to be construed as indicating or implying a relative importance or implicitly indicating the number of technical features indicated. Thus, features defining "first" and "second" may include one or more of the features either explicitly or implicitly. In the description of the present disclosure, the meaning of "a plurality" is two or more unless specifically defined otherwise.

In the present disclosure, the terms "install", "connected", "connect", "fix" and the like shall be understood broadly. For example, the connection may be a fixed connection or a detachable connection or integration; may be a mechanical connection or an electrical connection; may be directly connected, may be indirectly connected through an intermediate medium, or may be an internal communication of two elements or the interaction of two elements, unless explicitly stated and defined otherwise. For those skilled in the art, the specific meanings of the above terms in the present disclosure can be understood based on specific situations.

In the present disclosure, when a first feature is described to be "on" or "under" a second feature, situations may include direct contact of the first and second features, and may also include indirect contact of first and second features through another feature therebetween, unless otherwise specifically defined and defined. Moreover, when a first feature is described to be "over", "above" and "on" the second feature, situations include that the first feature is directly not directly above the second feature, or that the first feature is merely located higher than the second feature. When a first feature is described to be "under", "below" and "down" the second feature, situations include that the first feature is directly or not directly below the second feature, or that the first feature is merely located lower than the second feature.

The present disclosure is further described below in detail with reference to the accompanying drawings and specific implementations.

From FIG. 1 to FIG. 5, in this embodiment, an electrical connector is provided and can include:

a housing 3, provided with an installation cavity 6 and a jack 7 communicating with the installation cavity 6, where a first sliding channel 15 is disposed on a side wall of the installation cavity 6;

a conductive clamp 5, configured in the housing 3, where the conductive clamp 5 is provided with at least one pair of first clamping pieces 8 and at least one pair of releasing pieces 9 respectively configured on the first clamping pieces 8, and the first clamping pieces 8 and the releasing pieces 9 extend into the installation cavity 6;

a movable member 4, wherein the movable member 4 is configured in the housing 3 and is capable of moving back and forth along the first sliding channel 15; and a conducting wire 2, wherein the conducting wire 2 is capable of passing through the jack 7 and is inserted into one pair of first clamping pieces 8, so that the conducting wire 2 is electrically connected to the conductive clamp 5; the movable member 4 is capable of moving forward along the first sliding channel 15, and abutting on one pair of releasing pieces 9, to force the releasing pieces 9 and drive the first clamping pieces 8 to open outward, so that the conducting wire 2 is capable of detaching from the first clamping pieces 8. The electrical connector 1 is soldered to a PCB by using the conductive clamp 5.

The conducting wire 2 is inserted into the pair of first clamping pieces 8 through the jack 7, to open the first clamping pieces 8 outward. The first clamping pieces opening outward tightly clamp the conducting wire 2 under an action of reset force. When the conducting wire 2 needs to detach from the electrical connector 1, the movable member 4 is pushed forward, and a front end of the movable member 4 abuts on the pair of releasing pieces 9, to force the pair of releasing pieces 9 to open outward. The pair of releasing pieces 9 opening outward drives the pair of first clamping pieces 8 to respectively spread to both sides, so that the first clamping pieces 8 no longer clamp the conducting wire 2, and the conducting wire 2 detaches from the releasing pieces 9. When the acting force driving the movable member 4 to move forward is canceled, the pair of releasing pieces 9 opening outward pushes, under the action of a reset force, the movable member 4 to move backwards. In addition, the first clamping pieces 8 also resets, so that the first clamping pieces 8 may clamp the conducting wire 2 again when the conducting wire 2 is inserted again.

Figure 4:
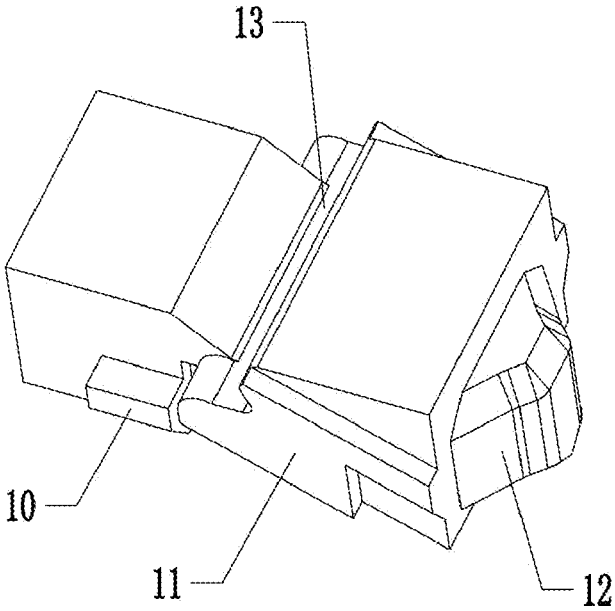
FIG. 4 is a shaft-side schematic structural diagram of a movable member according to an embodiment of the present disclosure.
Figure 5:
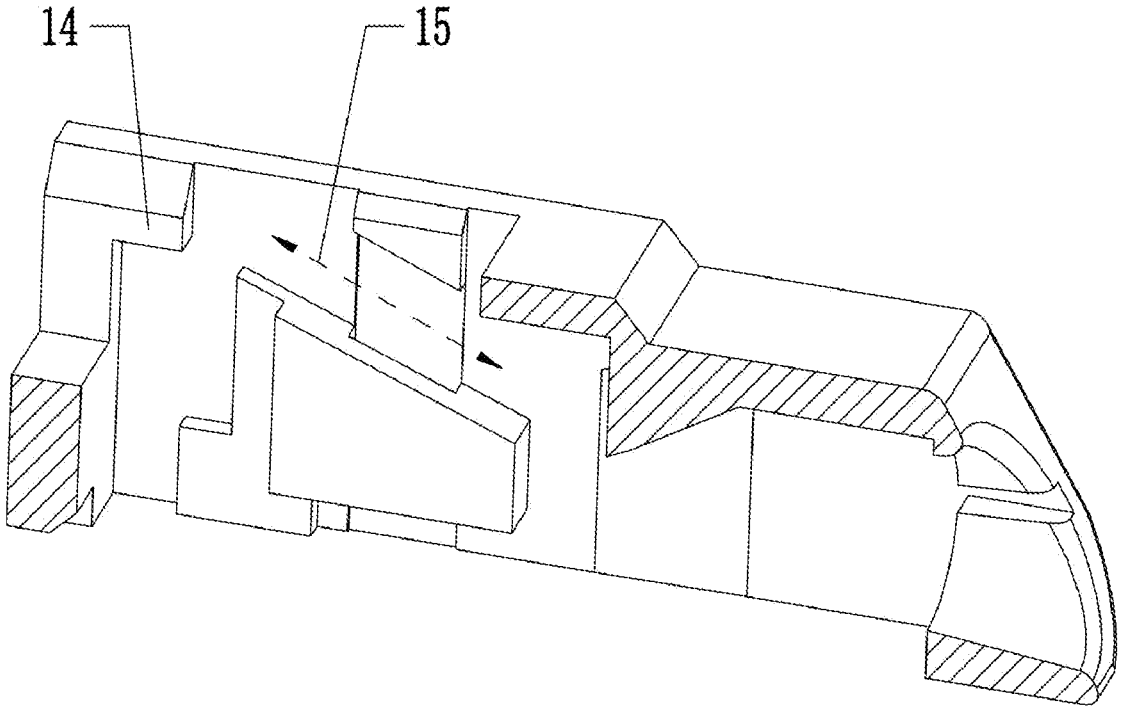
FIG. 5 is a schematic structural diagram of a section of a movable member according to an embodiment of the present disclosure.

As shown in FIG. 4 and FIG. 5, in this embodiment, the first sliding channel 15 is obliquely disposed on the side wall of the installation cavity 6, and the movable member 4 is provided with a sliding protrusion 11 adaptable to the first sliding channel 15. In this specification, the first sliding channels 15 are disposed on both sides of the installation cavity 6, and the sliding protrusions are disposed on both sides of the movable member 4. The first sliding channel 15 is obliquely disposed and the sliding protrusion 11 is also correspondingly obliquely disposed. Therefore, external force is exerted on the movable member 4, so that the movable member 4 may move forward relative to the housing 3. The external force may be horizontal or oblique downward. Because the electrical connector 1 is more miniaturized, it is inconvenient to exert a horizontal acting force to the movable member 4 during specific operation. However, an oblique downward force may be exerted on the movable member 4 in the electrical connector 1 in this specification during specific operation, thereby greatly facilitating the operation.

Figure 7:
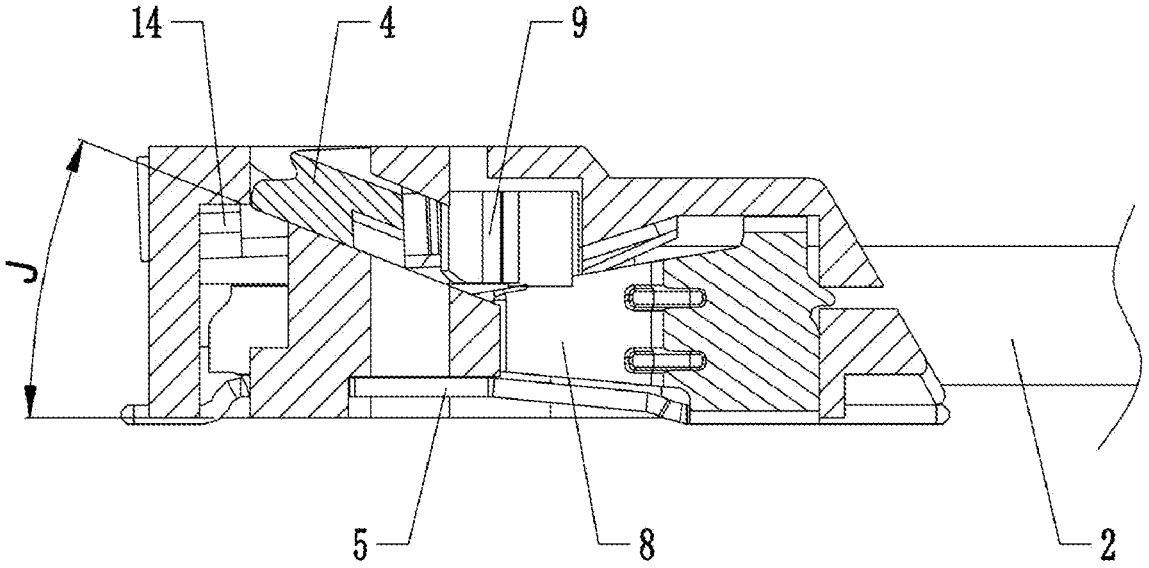
FIG. 7 is a schematic sectional view in a VII-VII direction in FIG. 2.

In addition, as shown in FIG. 7, in this embodiment, an angle J between the first sliding channel 15 and the horizontal plane is 22°. In another embodiment, the first sliding channel 15 and the horizontal plane may form an angle in a range of 15° to 35°.

Figure 6:
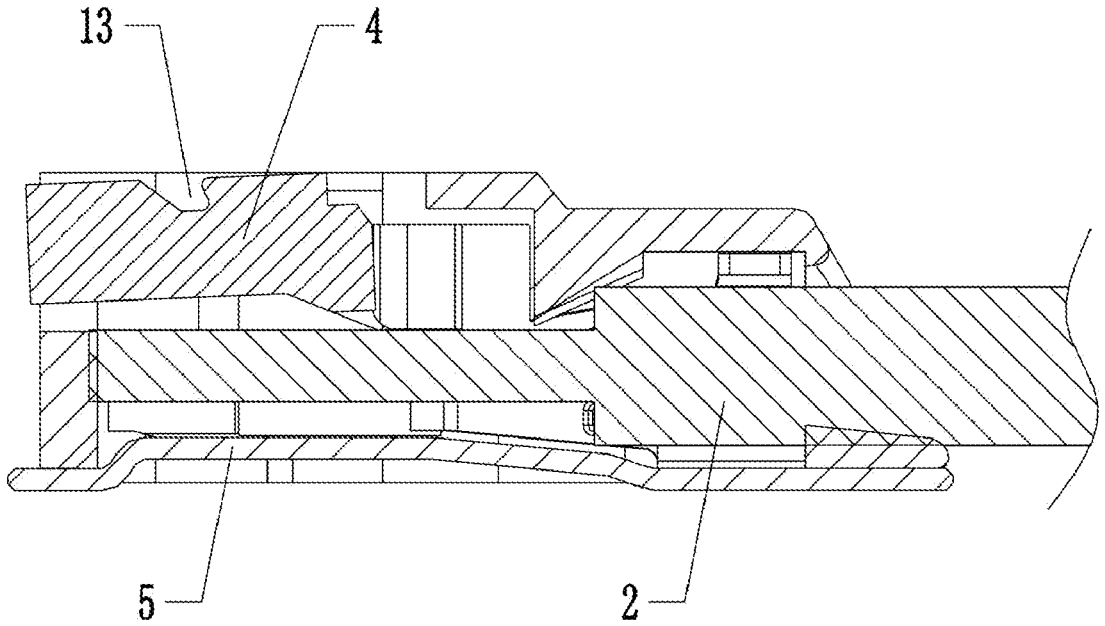
FIG. 6 is a schematic sectional view in an VI-VI direction in FIG. 2.

In addition, as shown in FIG. 4 and FIG. 6, in this embodiment, an operating groove 13 used to drive the conductive clamp 5 to move back and forth is disposed on an upper surface of the movable member 4, and the operating groove 13 tilts forward and is disposed on the upper surface of the movable member 4. Specifically, in this embodiment, an angle at which the operating groove 13 tilts is consistent with an angle at which the first sliding channel 15 tilts. In another embodiment, an angle at which the operating groove 13 tilts may be greater than an angle at which the first sliding channel 15 tilts by 0° to 10°.

Figure 3:
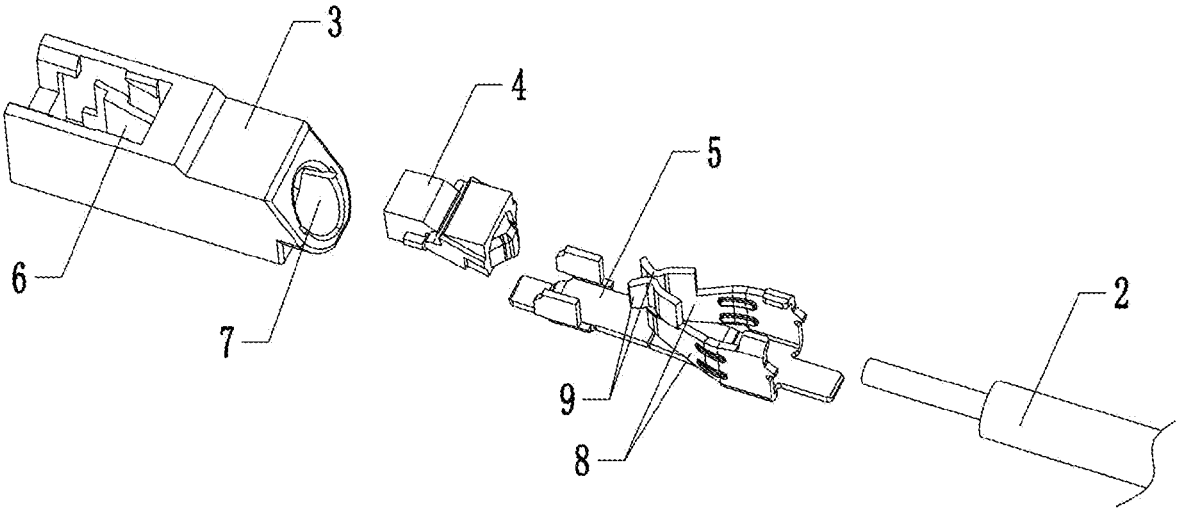
FIG. 3 is a schematic exploded view of an electrical connector according to an embodiment of the present disclosure.

As shown in FIG. 3, in this embodiment, the conductive clamp 5 is provided with the pair of first clamping pieces 8 and the pair of releasing pieces 9, the releasing pieces 9 are configured on the first clamping pieces 8 in a stacked manner. This not only facilitates opening of the first clamping pieces 8 through the releasing pieces 9, but also greatly shortens a length of the conductive clamp 5 to shorten a length of the electrical connector 1. In addition, in this embodiment, releasing piece 9 is a C-shaped sheet-like member, and the pair of releasing pieces 9 is respectively configured on the pair of first clamping pieces 8 in a back-to-back manner. The releasing pieces 9 in the foregoing structure help the movable member 4 to open the releasing pieces 9.

As shown in FIG. 4, FIG. 5, and FIG. 7, in this embodiment, the first sliding channel 15 is provided with at least one pair of limiting protrusions 14, and the movable member 4 is provided with clamping protrusions 10 that have a quantity consistent with a quantity of the limiting protrusions 14 and that are adaptable to the limiting protrusions 14, and the limiting protrusions 14 are capable of preventing the movable member 4 from detaching from the installation cavity 6. In addition, in this embodiment, an upper portion of the limiting protrusion 14 is provided with an oblique surface.

Specific assembling steps of the electrical connector 1 in this embodiment may be as follows:

first, pressing the conductive clamp 5 into the installation cavity 6 from bottom to top;

second, then pressing the movable member 4 into the installation cavity 6 from top to bottom, where because the upper portion of the limiting protrusion 14 is provided with the oblique surface, the movable member 4 may be conveniently pressed into the installation cavity 6.

As shown in FIG. 4, in this embodiment, the front end of the movable member 4 is provided with an abutting portion 12 extending forward, and two sides of the abutting portion 12 gradually shrink forward. In this embodiment, the abutting portion 12 is of a triangular shape with its angle outward. When the abutting portion 12 abuts on the releasing pieces 9, the abutting portion 12 in the foregoing structure can desirably open the pair of releasing pieces 9. In addition, during long-term frequent abutting operation, the abutting portion 12 does not cause the pair of releasing pieces 9 to relatively greatly deform, to avoid impact on normal operation of the electrical connector 1.

It should be noted that this embodiment of this specification merely provides a structure connected to the conducting wire 2. In another embodiment, the housing 3 may be provided with a plurality of pairs of installation cavities 6 and jacks 7, and the housing 3 may be provided with the pairs of installation cavities 6 and jacks 7 at intervals. Based on this embodiment, providing the plurality of pairs of installation cavities 6 and jacks 7 on the housing 3 is conventional in the art. Details are not described herein again.

In addition, another variant design may be made to the electrical connector in this specification. For example, the sliding channel used to guide the movable member may not be disposed on the side wall of the installation cavity 6, but disposed on the conductive clamp 5. Specifically, the conductive clamp 5 may extend upward to obtain a pair of mating sections. A second sliding channel (not shown in the figure) is disposed on the pair of mating sections, so that the movable member 4 may move back and forth along the second sliding channel. In the variant design, another structure and the basic working principle of the electrical connector are both the same as those in this embodiment. Details are not described again.

Thus, in the electrical connector 1 in this specification, the movable member 4 that may move back and forth may enable the conducting wire 2 to smoothly detach from the electrical connector 1.

The above is only some embodiments of the present disclosure and is not intended to limit the present disclosure. To those of ordinary skill in the art, various modifications and changes can be made to the present disclosure. Any modifications, equivalent substitutions, improvements, etc. made within the spirit and scope of the present disclosure are intended to be included within the scope of the present disclosure.

What is claimed is:

1. An electrical connector, comprising:

a housing, provided with an installation cavity and a jack communicating with the installation cavity;

a conductive clamp, configured in the housing, wherein the conductive clamp is provided with at least one pair of first clamping pieces, and at least one pair of releasing pieces respectively configured on the first clamping pieces, and the first clamping pieces and the releasing pieces are all located in the installation cavity;

a movable member, wherein the movable member is configured in the housing and is capable of moving back and forth along the installation cavity; and a conducting wire, wherein the conducting wire is capable of passing through the jack and is inserted into one pair of first clamping pieces, so that the conducting wire is electrically connected to the conductive clamp; the movable member is capable of moving forward along the installation cavity, and abutting on one pair of releasing pieces, to force the releasing pieces and drive the first clamping pieces to open outward, so that the conducting wire is capable of detaching from the first clamping pieces;

wherein the first sliding channel is obliquely disposed on the side wall of the installation cavity, and the movable member is provided with a sliding protrusion adaptable to the first sliding channel.

2. The electrical connector according to claim 1, wherein a side wall of the installation cavity is provided with a first sliding channel, and the movable member is capable of moving back and forth along the first sliding channel.

3. The electrical connector according to claim 1, wherein the conductive clamp is provided with a second sliding channel, and the movable member is capable of moving back and forth along the second sliding channel.

4. The electrical connector according to claim 1, wherein the first sliding channel and the horizontal plane form an angle in a range of 15° to 35°.

5. The electrical connector according to claim 1, wherein the releasing piece is a C-shaped sheet-like member, and the pair of releasing pieces are respectively configured on the pair of first clamping pieces in a back-to-back manner.

6. The electrical connector according to claim 1, wherein the installation cavity is provided with at least one pair of limiting protrusions, and the movable member is provided with clamping protrusions that have a quantity consistent with a quantity of the limiting protrusions and that are adaptable to the limiting protrusions, and the limiting protrusions are capable of restricting the movable member from detaching from the installation cavity.

7. The electrical connector according to claim 1, wherein a front end of the movable member is provided with an abutting portion extending forward, and two sides of the abutting portion gradually shrink forward.

8. The electrical connector according to claim 1, wherein an operating groove used to drive the conductive clamp to move back and forth is disposed on an upper surface of the movable member, and the operating groove tilts forward and is disposed on the upper surface of the movable member.

9. The electrical connector according to claim 1, wherein the releasing pieces are located on the first clamping pieces.

* * * * *